United States Patent [19]

Fossard

[11] 4,217,068

[45] Aug. 12, 1980

[54] PROTECTING DEVICE OF A CLAMPING MEANS FOR A SHEET-SHAPED MATERIAL WORKING MACHINE

[75] Inventor: Marcel Fossard, Cheseaux-sur-Lausanne, Switzerland

[73] Assignee: Raskin S.A., Switzerland

[21] Appl. No.: 938,523

[22] Filed: Aug. 31, 1978

[30] Foreign Application Priority Data

Sep. 14, 1977 [CH] Switzerland ..... 11227/77

[51] Int. Cl.[3] ..... B23Q 5/22; B65H 5/10

[52] U.S. Cl. ..... 414/20; 192/129 A; 72/1; 83/62; 269/23; 294/131; 408/710; 409/134; 414/730; 414/753

[58] Field of Search ..... 294/131; 408/710; 409/134; 83/58, 62, 62.1; 72/1; 269/23; 414/20, 677, 730, 751, 753; 271/258; 192/127, 129 A

[56] References Cited

U.S. PATENT DOCUMENTS 3,456,536 7/1969 Daniels ..... 83/62

FOREIGN PATENT DOCUMENTS 329753 12/1920 Fed. Rep. of Germany ..... 83/62

*Primary Examiner*—Stephen G. Kunin
*Assistant Examiner*—George F. Abraham
*Attorney, Agent, or Firm*—Silverman, Cass & Singer, Ltd.

[57] ABSTRACT

A protection device is provided for a machine which works sheet shaped material to stop the displacement of the machine when the protection device encounters an obstacle. The machine includes clamps which are displaced by the machine and which hold the material. The protection device includes two blades arranged parallel to each other and disposed on the machine in a loop shape surrounding each clamp. The two blades form a pair of normally open contacts of which at least the outer blade is flexible and resiliently deformable to allow the blades to be brought into contact with each other and close the contacts when the outer blade encounters the obstacle. A stop device is coupled to the normally open contacts to stop the displacement of the machine when the contacts are closed.

3 Claims, 3 Drawing Figures

PROTECTING DEVICE OF A CLAMPING MEANS FOR A SHEET-SHAPED MATERIAL WORKING MACHINE

BACKGROUND OF THE INVENTION

The present invention relates to a protecting device for clamps of a machine which works sheet shaped material.

In machines which work iron sheet or iron plate movements of the pieces being worked are produced by clamps gripping the iron sheets, these clamps being carried by movable carriages of the machine.

These clamps are provided, in most cases, with a protecting device intended to stop the machine if an obstacle is encountered. To this end, the machine comprises a stop device producing the instantaneous stopping of the machine. This device is arranged or connected between a protecting member, generally an iron wire, surrounding the clamping device, and a positive pole of a source of current, a negative pole of which is connected to earth or machine ground. It results from this arrangement that, if the clamps encounter a metallic element lying on their path, and which is connected to the mass of the machine, a feed circuit of the stop device producing the instantaneous stopping is closed, thus stopping the machine.

Such protecting devices exhibit the drawback that, if the obstacle is not conductive or if, the obstacle is conductive but is not in contact with the mass of the machine, the protecting device is ineffective. The fingers of the operator, for instance, are not protected by such a device.

The purpose of the present invention is to remove this drawback.

SUMMARY OF THE INVENTION

To this effect, the protecting device according to the invention comprises two contact members disposed parallel with respect to each other and having each shape of loops surrounding the clamp. At least the outer contact member is flexible and resiliently deformable so that, if an obstacle is encountered during the displacements of the clamps the outer contact member becomes deformed and comes into contact with the inner contact member, thus closing an electric circuit feeding a device producing the instantaneous stopping of the machine.

BRIEF DESCRIPTION OF THE DRAWING

The drawing shows, by way of example, one embodiment of the object of the invention.

DESCRIPTION OF THE PREFERRED EMBODIMENT

Figure 1:
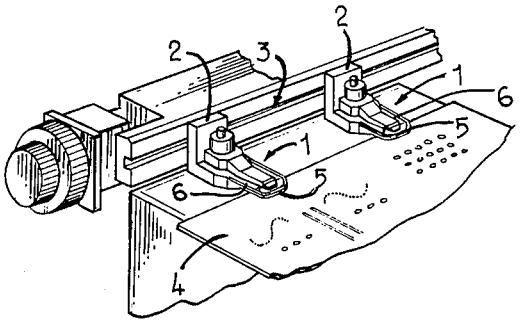
FIG. 1 is a perspective view of a portion of a for working sheet shaped material machine.
Figure 2:
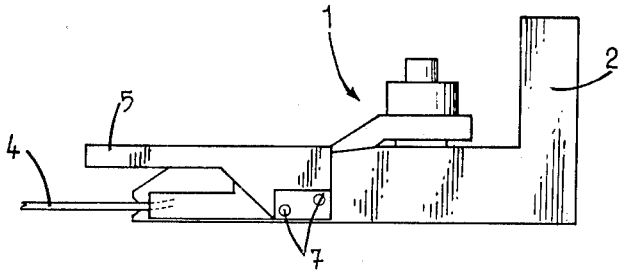
FIG. 2 is a side elevational view of a detail of the machine of FIG. 1, at a larger scale.

The machine partially represented in FIG. 1 comprises two sheet shaped material clamps 1 carried by a carriage 2 moving along a slideway 3 in a frame of the machine. These clamps clamp or hold a sheet of iron 4 and produce the displacements thereof.

Each clamp is provided with a protecting device comprising two elastic blades 5 and 6, situated opposite each other and constituting a double wire surrounding the clamp. These blades are secured to the frame of the clamp by means of screws 7. The inner blade 6 is connected to the mass of the machine while the outer blade

5 is insulated therefrom by means of insulating blocks 8, securing screws 7 are provided in the vicinity of their heads, with insulating sleeves which have not been represented.

Figure 3:
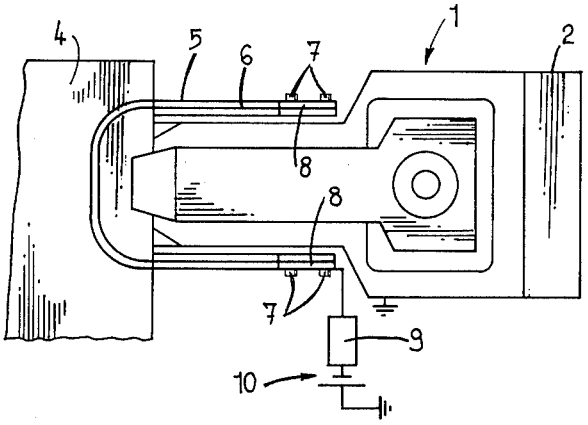
FIG. 3 is a plan view of the detail of FIG. 2.

The machine comprises a stop producing the instantaneous stopping of the machine, diagrammatically represented at 9 in FIG. 3. This stop device is arranged or connected between the outer blade 5 of the protecting device and the positive pole of a source of current 10 the negative pole of which is connected to the mass of the machine.

If results from this arrangement that, if an obstacle lies on the path of either of the clamps 1, this obstacle is knocked or contacted by the outer blade 5 during the displacements of the clamp. Blade 5 is then deformed resiliently so that it encounters the inner blade 6 and thus closes a feed circuit of the stop device 9 producing the instantaneous stopping of the machine. In spite of the fact that this stopping is not absolutely instantaneous, the continuation of the displacement of the clamps during a short instant does not produce any damage to the protecting device since the inner blade 6 is also resiliently deformable, as is the outer blade 5, so that blade 6 becomes deformed when it is submitted to a pressure produced by the blade 5.

The stopping is produced no matter what may be the nature of the obstacle, and whether the obstacle is conductive or not. However, it is to be noted that if the obstacle is conductive and is in contact with the mass of the machine, the feed circuit of the stop device 9 will be closed even before the blade 5 is entered into contact with the blade 6 since the mere contact of blade 5 with the suchan obstacle will place blade 5 in electrical contact with the mass of the machine.

What I claim is:

1. A protecting device for stopping the displacement of a machine which works sheet shaped material when the protecting device encounters an obstacle, the machine including clamps which hold the material and which are displaced by the machine, the protection device for each clamp comprising:

outer and inner contact members arranged parallel to each other and disposed on the machine in a loop shape surrounding the clamp with the inner contact member adjacent the clamp, the members forming a pair of normally open contacts with at least the outer contact member being flexible and resiliently deformable to allow the members to be brought into contact with each other and close the contacts when the outer contact member encounters the obstacle; and stop means coupled to the pair of normally open contacts for stopping the displacement of the machine when the normally open contacts are closed.

2. The device as claimed in claim 1 further including a current source having a positive pole and a negative pole, and in which the machine is electrically conductive, the stop means are electrically connected between the outer contact member and one of the poles, the machine is electrically connected to the other pole and the inner contact member is electrically connected to the machine so that any electrical conductive coupling of the outer contact member to either the inner contact member or the machine electrically conductively couples the inner and outer contact members.

3. The device as claimed in claim 1 in which each contact member is a resilient blade arranged opposite the other blade, each blade includes ends and each blade is secured to the clamp by its ends.

* * * * *